US005161791A

United States Patent [19]

Akiyama et al.

[11] Patent Number: 5,161,791

[45] Date of Patent: Nov. 10, 1992

[54] FEEDING APPARATUS FOR SHEETS

[75] Inventors: Sakai Akiyama, Takasaki; Seishi Terasawa, Maebashi, both of Japan

[73] Assignee: Fuji Manufacturing Corporation Ltd., Gumma, Japan

[21] Appl. No.: 702,768

[22] Filed: May 15, 1991

[30] Foreign Application Priority Data

May 15, 1990 [JP] Japan ..... 2-124633

[51] Int. Cl.[5] ..... B65H 5/08

[52] U.S. Cl. ..... 271/12; 414/798.9; 156/556; 156/566; 271/94; 271/104; 271/107; 271/149; 271/24; 271/31.1

[58] Field of Search ..... 271/94, 101, 104, 107, 271/149, 126, 28; 221/211; 53/136.1, 135.1, 129.1; 156/556, 566, 567, 568, 570; 414/798.9

[56] References Cited

U.S. PATENT DOCUMENTS

| | | | |
|---|---|---|---|
| 3,005,744 | 10/1961 | McFarlane | 271/12 X |
| 3,536,570 | 10/1970 | Holstein | 271/102 X |
| 3,726,746 | 4/1973 | Hansen | 156/566 |
| 3,841,623 | 10/1974 | McCarthy et al. | 271/126 |
| 4,065,909 | 1/1978 | Mueller | 53/129.1 |
| 4,097,040 | 6/1978 | Pugh et al. | 271/107 X |
| 4,505,467 | 3/1985 | Brocklehurst | 271/11 X |
| 4,537,208 | 8/1985 | Kulhl | 271/31.1 X |
| 4,590,872 | 5/1986 | Bray | 271/11 X |
| 4,690,395 | 9/1987 | Nowicki | 271/31.1 X |

FOREIGN PATENT DOCUMENTS

| | | | |
|---|---|---|---|
| 0254435 | 11/1986 | Japan | 271/107 |
| 0242332 | 9/1989 | Japan | 271/107 |
| 1155501 | 5/1985 | U.S.S.R. | 156/566 |

OTHER PUBLICATIONS

Home, Automatic Vacuum Feed Hopper, Jul. 1976, vol. 18, No. 2, p. 442.

*Primary Examiner*—H. Grant Skaggs
*Assistant Examiner*—Carol Lynn Druzbick
*Attorney, Agent, or Firm*—Weintarub, DuRoss & Brady

[57] ABSTRACT

An apparatus for feeding sheets such as labels or covers includes a holder having a groove-shaped cross section opening upwardly. The holder is formed with a take-out port at one end, and holds the covers stacked horizontally with their surfaces facing horizontally. A pressing body connected to a rodless cylinder presses the stacked covers with a constant force towards the take-out port. A suction machine having a sucking disk at one end confronting a cover exposed from the take-out port attracts the exposed cover one-by-one. A stepping motor coupled to the suction machine turns the suction machine downwardly to 90° so that the cover attracted to the sucking disk abuts against a top aperture of a container which is carried on a conveyor. When the suction machine releases the attraction of the cover, the cover is left on the top aperture of the container to cover the top aperture.

4 Claims, 4 Drawing Sheets

FEEDING APPARATUS FOR SHEETS

BACKGROUND OF THE INVENTION

1. Field of the Invention

The present invention relates to an apparatus for feeding sheets, such as labels or covers for plastic containers, one by one from a plurality of sheets and delivering each sheet to a predetermined article.

2. Prior Art

An apparatus for sequentially feeding sheets, such as labels or covers for plastic containers, is disclosed in Japanese Patent Publication No. 55-26044.

This apparatus includes a holder for storing the covers for containers in a lapped condition. The holder is disposed above a conveyor, which transports the containers, the containers have so-called cup noodles therein. A main shaft is disposed extending between the conveyor and the holder. The main shaft is provided with a plurality of suction machines for withdrawing the covers from the holder, such that the suction machines protrude upwardly and downwardly from the main shaft.

The main shaft and suction machines operate such that the withdrawn label or cover is delivered by the main shaft synchronously to the arrival of the container on the conveyor. The holder is formed with a take-out port for exposing a front face of the cover. A plurality of claws protruding from an edge of the take-out port support the cover which is positioned at the lowest position, so that the cover does not fall from the take-out port.

Accordingly, the suction machines attract the covers, one by one, from the holder and remove the covers individually from the take-out port. When the main shaft is rotated, the cover is turned to the lower side. The cover is delivered to the container, which is transported on the conveyor.

In this feeding apparatus however, the holder of the covers is disposed such that the direction of lapping of the covers is vertical. The load applied between the claws of the holder is proportional to the amount of lapped covers contained therein. The load is therefore not constant. As a result, when the number of covers is small, the load is not great enough to allow the withdrawal by the suction machines. Conversely, when the number of covers is excessive, the friction between the cover to be withdrawn and the claws is too great. The cover cannot be released by the claws due to the friction, and the cover is not withdrawn.

Furthermore, the cover is rotated 180° by the main shaft from the holder to the container positioned on the conveyor below. Thus, the operational speed of the apparatus is limited and substantial efficiency of operation is lost.

The present invention was made in view of the problems cited and it is an object of the present invention to provide an apparatus for feeding sheets to whereby predetermined articles on a conveyor, the withdrawal of the sheet from a rack by a suction machine is accomplished smoothly, improving the operational efficiency.

SUMMARY OF THE INVENTION

The present invention is an apparatus for sequentially feeding sheets, including a rack for holding a plurality of sheets, the rack having a take-out port formed at an end thereof such that the front sheet of the plurality is exposed. The sheets are supported by a plurality of claws, the claws protruding from an inner ring disposed around the edge of the take-out port. The rack is disposed such that the sheets are stacked horizontally. A means for pressing the sheets is disposed within the rack at the rear side of the plurality of sheets. The means for pressing comprises a pressing body for urging the sheets towards the take-out port with a constant force and a rodless cylinder supplying the force to the pressing body. The apparatus further comprises a plurality of articles to receive sheets, a conveyor transporting the articles sequentially. A means for delivering the sheets sequentially to articles is disposed between the holder and the conveyor, the conveyor being disposed below the holder. The means for delivering includes a means for withdrawing the exposed sheet from the take-out port of the holder, and a means for rotating the means for withdrawing.

In the apparatus the means for withdrawing includes a suction machine, which faces the take-out port of the rack and draws out the exposed sheet from the claws disposed around the take-out port, a sucking disk and a cylinder connecting the sucking disc and the sucking machine. The means for rotating maneuvers the suction machine together with the withdrawn sheet. By releasing the suction, the withdrawn sheet is supplied to an article as the articles are transported by the conveyor.

The means for pressing urges the sheets within the rack towards the take-out port with a constant force. Therefore, the force supplied by the means for withdrawing is not changed. As a result, the withdrawal is performed reliably. In particular, since the rack is disposed horizontally, the weight of the sheets is not applied to the plurality of claws at the take-out port. Thus, the force imparted between the sheets and the claws does not vary with the number of sheets in the rack.

Furthermore, the means for rotating need only turn about 90°. As a result, as compared with the known apparatus, which requires to turn by 180°, the mechanical operation efficiency of the present invention is improved.

The above will become better understood by reference to the drawings, wherein like numbers refer to like components.

DESCRIPTION OF THE PREFERRED EMBODIMENT

Figure 1:
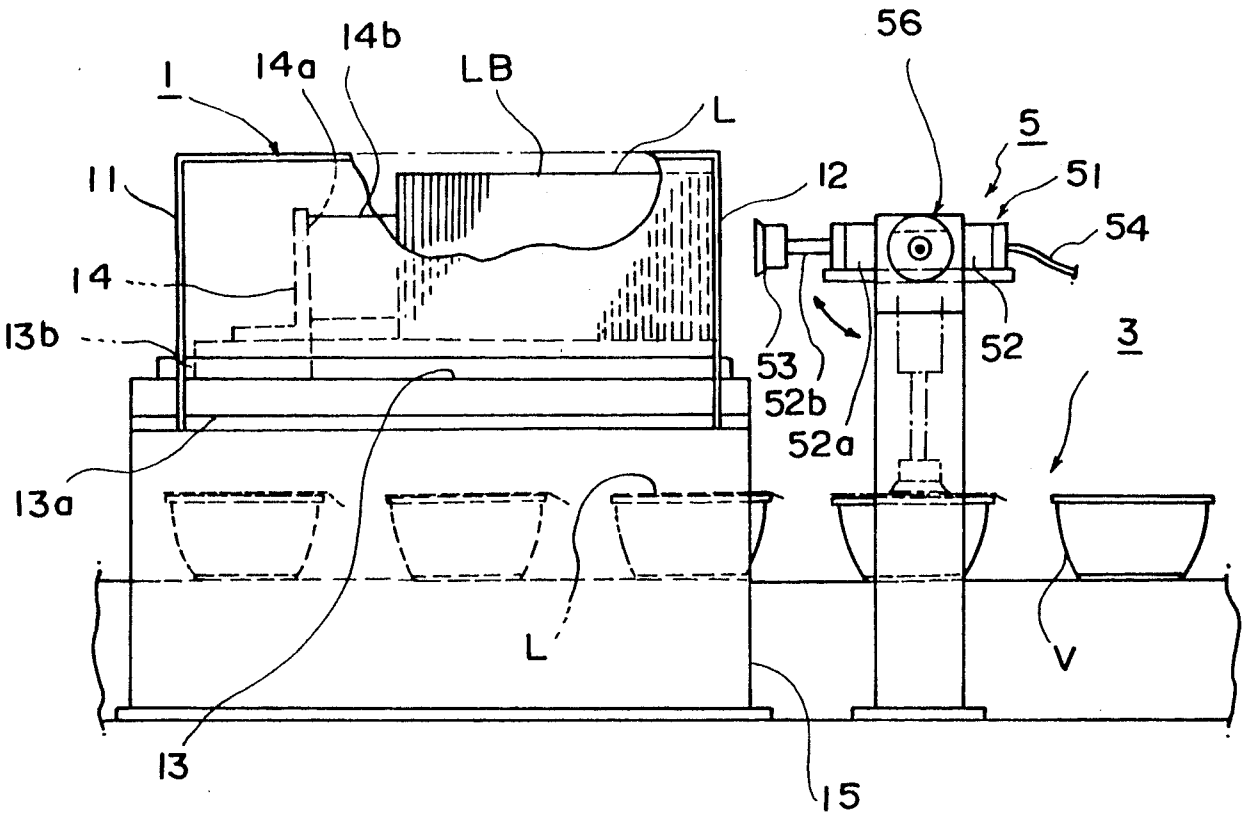
FIG. 1 is a side view of the apparatus showing label pieces according to an embodiment of the present invention.

Referring to the drawings, and with reference to FIGS. 1–6, a plurality of containers sequentially presented on a conveyor, an apparatus for feeding sheets is depicted, wherein each of the label pieces L has a substantially circular shape. An ear portion Lp is formed at a portion of the label pieces L to allow peeling of the label piece L from a container.

The apparatus includes a rack 1 for holding a plurality of labels LB therein. The apparatus further includes a conveyor 3, disposed below the rack 1, for transporting a plurality of containers V thereon. The apparatus further includes a means for delivering 5 the labels the means 5 for delivering being disposed adjacent to the rack 1 and above the conveyor 3. The means for delivering 5 transports sequentially the labels LB from the rack 1 to the containers V.

In practice, the rack 1 and the means for delivering 5 are disposed in multiples along a width direction of the conveyor 3. The conveyor 3 transports a plurality of containers V aligned in the width direction, and thus, in parallel along the path of the conveyor 3. However, in FIG. 2, only one combination of the rack 1 and the means for delivery 5 are shown at one side of the conveyor 3.

The rack 1 is fixed on an arch-shaped support table 15 which straddles the width of the conveyor 3. Each rack 1 includes a holder 11 for storing the plurality of labels LB, a rodless cylinder 13 fixed on a lower inside of the holder 11, and a pressing body 14 disposed between the rodless cylinder 13 and the plurality of labels LB within the holder 11. The rodless cylinder 13 and the pressing body 14 constitute a means for pressing.

The holder 11 has a groove-shaped cross sectional opening facing upwardly. The holder 11 further has a groove hole formed in the bottom therein to avoid interference with the ear portion Lp of the label piece L. The holder 11 holds the plurality of labels LB such that the direction of the label pieces L are horizontal and parallel to the conveyor 3. Furthermore, the holder 11 is formed with a take-out port W in the side facing the means for delivering 5. The take-out port W has the same inner contour as the label piece L, allowing the front surface of the label piece L to be exposed through the take-out port W. A ring 12, having the same shape as and affixed to the take-out port W, has a plurality of claws P protruding inwardly therefrom. The claws P prevent the label piece L from passing through the take-out port W until withdrawal is desired.

The rodless cylinder 13 is disposed within the holder 11. The rodless cylinder 13 includes a cylinder main body **13*a* and a piston mount 13*b*, the piston mount 13*b* being movable on the groove hole formed in the holder 11 and is parallel to the main body 13*a*. The piston mount 13*b* is disposed within the groove hole 11*a* of the holder 11 and extend upwardly therefrom into the inside of the holder 11**.

Figure 5:
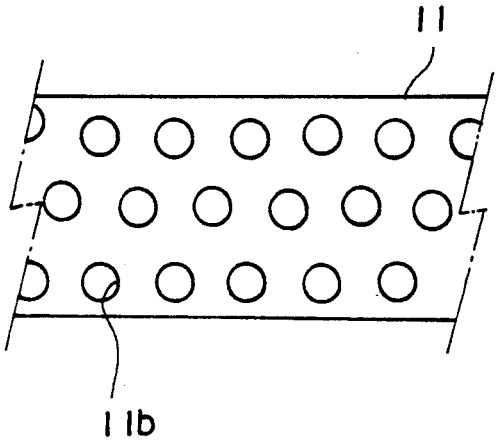
FIG. 5 is a side view of the side plate of the rack in FIG. 1.

Side plates of the holder 11 are formed of punched metal plates having a multiplicity of holes **11*b*, as shown in FIG. 5. The friction between the plurality of labels LB and the holder 11 is reduced by the holes 116**, thus making the movement of the group of labels LB smoother.

A pressing body 14 is disposed within the holder 11. The pressing body 14 comprises a main body **14*a*, having an L-shaped side view and a plurality of pressing plates 14*b* fixed to a vertical plate portion of the main body 14*a*. The pressing plates 14*b* are respectively perpendicular to the vertical plate portion of the main body 14*a* and in parallel with one another along a longitudinal axis of the holder 11. Free ends of the pressing plates 14*b* are in abutment with a rear surface of the plurality of labels LB. The main body 14*a* is connected to the upper end of the piston mount 13*b* of the rodless cylinder 13. Accordingly, when the rodless cylinder 13 is operated, the main body 14*a* is moved within the holder 11. The group of labels LB are therefore urged towards the take-out port W of the holder 11**.

Figure 6:
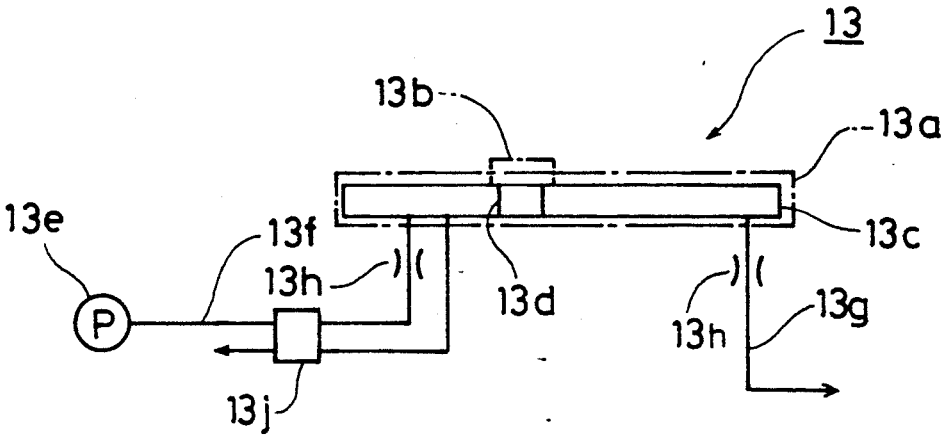
FIG. 6 is a schematic view of a structure of the rodless cylinder.

The rodless cylinder 13, as shown in FIG. 6, has a piston **13*d* moved by air pressure along the inside a main body 13*a*. A cylinder area 13*c*, within the main body 13*a*, is in fluid communication at its rear side with an inlet passage 13*f*, which in turn is in fluid communication with a pump 13*e*. The cylinder 13*c* is connected at its front side with an exhaust passage 13*g*. The inlet passage 13*f* is provided with a selector valve 13*j*. The exhaust passage 13*g* is provided along its intermediate portion with a throttle valve 13*h*. Thus, the pressing force of the piston mount 13*b* is always maintained at about 1.5 kg independent of the magnitude of a load by virtue of the these throttle valve 13*h* and the selector valve 13*j***.

The conveyor 3 is disposed parallel to the longitudinal direction of the holder 11. The conveyor 3 transports the containers V, which are placed at equal intervals along the conveyor 3.

The means for delivering 5 is composed of a means for withdrawing the exposed label piece L and a means for rotating 56, constituted by a stepping motor, connected to the means for withdrawing.

Specifically, the means for withdrawing includes a suction machine 51, a cylinder 52, a sucking disk 53 fixed to an end of a cylinder rod **52*b* of the cylinder 52, and a tube 54 beginning at the suction machine 51 and extending through the cylinder 52 to the sucking disk 53. The stepping motor 56 is connected to the suction machine 51** and rotates it.

Accordingly, the suction machine 51 can be turned by 90° from a horizontal condition downwardly to vertical condition about the axis of the stepping motor 56. When horizontal, advancing the cylinder rod **52*b* forward with respect to the main body 52*a* places the sucking disk 53 against the label piece L in the rack 1**. After withdrawing the label and rotating the means for withdrawing to the vertical condition, the withdrawn label piece L is abuttable against the upper portion of the container V.

The sucking disk 53 is connected to a suction block (not shown) through the tube 54. A selector valve and a change-over mechanism (both not shown) are further provided to operate so that when the sucking disk 53 is brought into contact with the label piece L, the withdrawal occurs. The label piece L is attracted to the sucking disk 53 by the suction supplied by the suction machine 51 through the tube 54. When the label piece L is placed in contact with the upper portion of the container V, the suction is released, as is well known in the art.

In practice, a plurality of suction machines 51 are disposed along the width direction of the conveyor 3 and are connected by a rod 57. All the suction machines 51 are then rotated by the single stepping motor 56. The conveyor 3 and the suction machines 51 of the means for delivering 5 are controlled by a control mechanism (not shown). The feeding of label piece L and the transportation of the containers V are thereby synchronized with each other.

Figure 2:
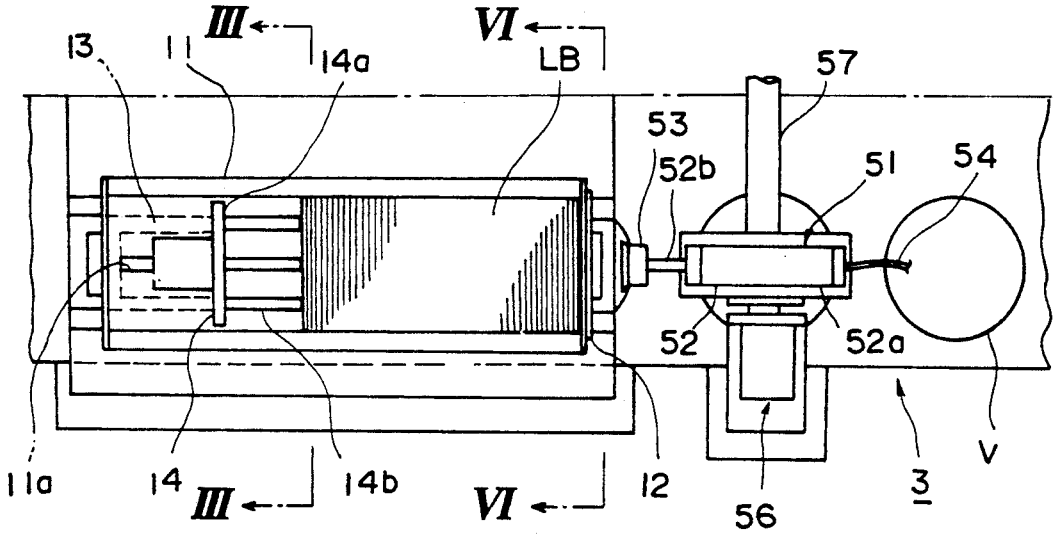
FIG. 2 is a plan view of a part of the feeding apparatus of FIG. 1.
Figure 3:
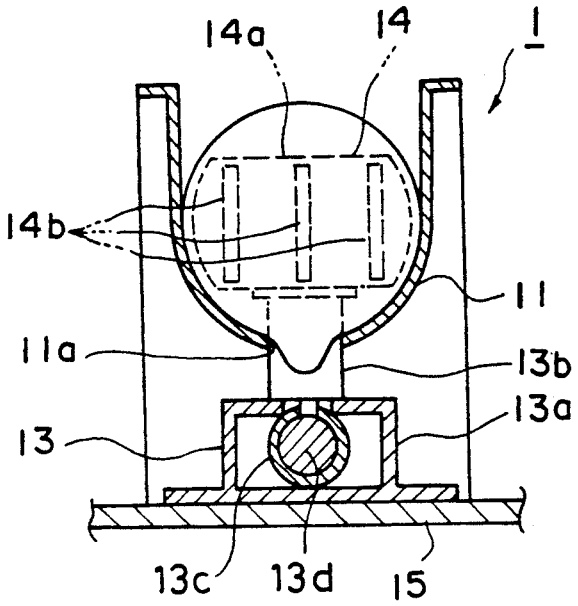
FIG. 3 is a side sectional view taken along the line 3—3 in FIG. 2.
Figure 4:
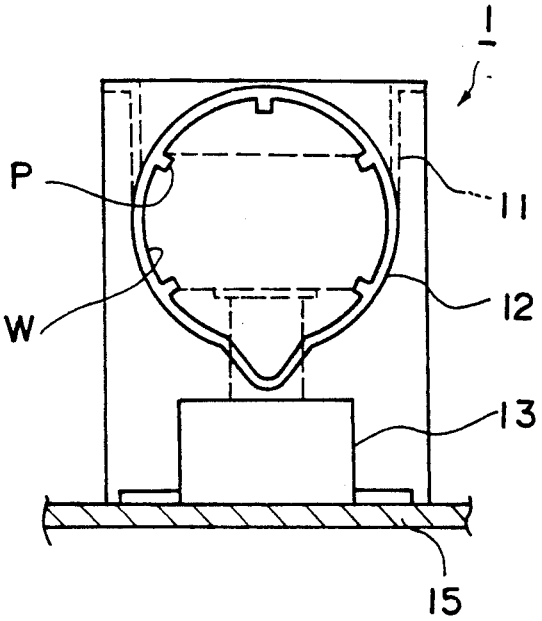
FIG. 4 is a side sectional view taken along the line 6—6 in FIG. 2.

The operation will be described with reference to FIGS. 1 and 2.

A plurality of labels LB are inserted into the holder 11. The pressing body 14 urges the plurality of labels LB towards the take-out port W by the operation of the rodless cylinder 13. A label piece L, positioned by the take-out port W, is held the claws P at the inner edge of the take-out port W until withdrawal is desired.

When the means for delivering 5 is actuated, the sucking disk 53 is brought into contact with the label piece L exposed in the take-out port W by the extension of the cylinder 52. The sucking disk 53 attracts the label piece L by the suction supplied by the suction machine 51 through the tube 54. By retracting the cylinder 52, the label piece L is drawn out of the holder 11, overcoming the holding force of the claws P. With the label piece L being pressed by the means for pressing 14 while on the holder 11, the sucking disk 53 is certain to contact the label piece L, and a failure to withdraw will not occur. Furthermore, since the direction of the label pieces L is horizontal, as opposed to vertical, the load of the labels LB is not applied to the claws P. Thus, a failure to draw out the label piece L can be prevented. Thereafter, when the stepping motor 56 is operated, the suction machine 51 is turned from the horizontal condition to the vertical condition.

The label piece L drawn to the sucking disk 53 is rotated downwardly by 90° about the axis of the stepping motor 56. The stepping motor extends laterally or orthogonally to the longitudinal axis of the holder 11 in a horizontal plane. Thus, the label piece L is turned from a position facing the rack 1 to a position facing the conveyor 3. When the cylinder 52 is again advanced, the label piece L is brought into contact with the upper portion of the container V. The suction is released and the label piece L is left on the container V. The opening portion of the container V is closed or covered by the label piece L, which serves as a cover of the container V.

Thereafter, by retracting the cylinder 52 and by returning the suction machine 51 to the horizontal condition, the means for delivering 5 is returned to a waiting condition for the delivery of the next label piece L to the next container V. This return motion is accomplished by rotation of the stepping motor, as is known in the art. Accordingly, by repetition of this operation, the containers V transported by the conveyor 3 can be covered sequentially by the label pieces L.

As described in the foregoing, the pressing force applied to the claws P is always set constant independent of the amount of the label pieces L remaining in the holder 11. As a result, the suction machine 51 is operated reliably, and the delivery operation of the label pieces L can be performed smoothly.

In particular, even when the number of the label pieces L is increased, no failure is caused in the withdrawal of the label pieces L by the means for withdrawing.

Furthemore, in the feeding apparatus in the embodiment, since the turning angle of the suction machine 51 is 90°, the limitation to the mechanical operating speed is reduced. Thus, the feeding apparatus can be operated at higher speeds, thereby increasing the operational efficiency.

While the means for turning is constituted by the stepping motor in this embodiment, it may be constituted by a motion mechanism utilizing a cam mechanism.

In the embodiment, although the apparatus feeds label pieces L as sheets, the present invention is not limited to this, and the apparatus may feed covers as is known in the art, or may feed bags of condiments of instant noodles.

As decribed above, the present invention provides two advantages. First, the pressing force applied to each to sheet as it is withdrawn is made constant independent of the number of sheets remaining in the holder. As a result, the drawing out of the sheet by the suction machine can be performed smoothly.

Furthermore, since the turning angle of the suction machine can be reduced, the limitation to the mechanical operating speed can be increased, and thus, the operation efficiency can be improved.

Having, thus, described the invention, what is claimed is:

1. An apparatus for feeding sheets comprising:

(a) a stationary horizontal rack capable of holding a plurality of sheets therein, the rack including:

(i) a sheet holder having a groove formed therein, the holder having an opening formed at an upper portion thereof, the sheets being held horizontally in the groove, the sheets being slidable in a horizontal and axial direction;

(ii) a take-out port formed in one side of the holder, the take-out port having substantially the same inner contour as the sheets to allow the sheets to be exposed through the take-out port;

(iii) a ring disposed on the rack proximate the take-out port; and (iv) a plurality of claws disposed on the ring for retaining the sheets within the holder;

(b) a pressing body which contacts the plurality of sheets; and (c) a rodless cylinder having a piston mount and a cylinder body, the piston mount connected to the pressing body, wherein the rodless cylinder applies a steady pressure to the pressing body, to keep a level force forward on the plurality of sheets;

(d) a conveyor disposed below the rack, the conveyor transporting a plurality of containers thereon; and (e) means for delivering the sheets one by one to each of the plurality of containers, the means for delivering comprising:

(i) means for withdrawing a sheet from the take-out port of the rack; and (ii) means for rotating the means for withdrawing.

2. The apparatus of claim 1, the means for withdrawing comprising:

(a) a suction machine which supplies an air force through a tube to attract a cover thereto;

(b) a cylinder attached to the suction machine, the tube extending therethrough; and (c) a sucking disk, the sucking disk extending from the cylinder and attached to the tube, the sucking disk contacting the sheet to be withdrawn from the rack and drawing it to itself by the air force provided by the suction machine.

3. The apparatus of claim 1, the means for turning comprising a stepping motor connected to the means for withdrawing.

4. The apparatus of claim 1, wherein the rotation of the means for rotating is up to about 90°.

* * * * *